US005860908A

United States Patent [19]

Forrester

[11] Patent Number: 5,860,908

[45] Date of Patent: Jan. 19, 1999

[54] WATER INSOLUBLE HEAVY METAL STABILIZATION PROCESS

[76] Inventor: Keith Edward Forrester, P.O. Box 2008, Hampton, N.H. 03843-2008

[21] Appl. No.: 729,665

[22] Filed: Oct. 7, 1996

[51] Int. Cl.[6] ..... A62D 3/00; B09D 3/00

[52] U.S. Cl. ..... 588/256; 405/128

[58] Field of Search ..... 588/252, 256, 588/257; 210/768; 405/128

[56] References Cited

U.S. PATENT DOCUMENTS

| | | | |
|---|---|---|---|
| 5,234,498 | 8/1993 | Graves, Jr. | 588/252 X |
| 5,284,636 | 2/1994 | Goff et al. | 588/256 X |
| 5,550,314 | 8/1996 | Laughlin | 588/256 |
| 5,569,155 | 10/1996 | Pal et al. | 588/256 |
| 5,645,518 | 7/1997 | Wagh et al. | 588/252 |
| 5,769,938 | 6/1998 | Ueshima et al. | 588/257 X |

*Primary Examiner*—George Suchfield

[57] ABSTRACT

Ash residues produced from solid waste combustion and certain industrial residues which are sometimes contacted with water for dust control, quenched for temperature reduction or subjected to water separation methods, have lead (Pb) and other heavy metals in sufficient solubility to sometimes fail the USEPA TCLP test and other acid leaching tests. Addition of a water-insoluble precipitating agent, such as pulverized phosphate rock or a precipitating agent coated with a water-insoluble film, during waste generation or collection allows the waste to pass TCLP regulatory testing, reduces Pb leaching under acid conditions and provides a water-insoluble stabilizing seed which will remain with the residue throughout water spraying, quenching or wet processing.

10 Claims, 1 Drawing Sheet

WATER INSOLUBLE HEAVY METAL STABILIZATION PROCESS

FIELD OF INVENTION

This invention relates to a method for stabilizing heavy metals from solid residues, and more particularly stabilizing lead and cadmium contained in ash residues from the incineration or combustion of solid wastes, and fluff wastes produced from the shredding of wire and automobiles.

BACKGROUND OF INVENTION

The leaching of heavy metal bearing wastes and human and biological exposure to heavy metal content has long been of concern to environmental regulators and waste producers. Under the Resource Conservation and Recovery Act (RCRA) solid waste is classified by the U.S. Environmental Protection Agency (EPA) as hazardous waste if excessive amounts of heavy metals leach from the waste when tested under the Toxicity Characteristic Leaching Procedure (TCLP). EPA also regulates the land disposal of certain heavy metal bearing wastes depending on the content of the heavy metals regardless of the leaching potential. In addition, several state governments require solid wastes with elevated levels of heavy metals be disposed of as a hazardous waste. Disposal of waste at a hazardous waste landfill is typically more expensive than disposal at non-hazardous waste landfills.

To reduce the expenses associated with the landfill disposal of heavy metal leachable waste, particularly lead bearing waste, various methods to control heavy metal leaching and reduce heavy metals have been developed. These methods include the stabilization of lead bearing waste with, for example, portland cement, silicates, sulfates, water soluble phosphates and combinations thereof as well as acid digestion and subsequent extract metals recovery. However, these methods are often expensive to perform and involve complex handling equipment and operations. Additionally, some of these methods use chemicals, such as high molarity acids, which in the amounts used, are very corrosive to the waste generation and/or treatment process equipment. These methods also alter the nature of the waste which complicates the ability of the waste to be further processed. These methods also use water soluble chemicals which, upon additional wet processing of the waste, are subject to loss due to water solution stripping.

Thus a need exists for means of reducing lead leaching from the lead bearing waste which are less expensive, less damaging to equipment and allows the waste to be further processed and handled after stabilization.

SUMMARY OF INVENTION

The purpose of this invention is to increase the immobilization of heavy metals in waste contaminated materials to reduce the loss of stabilization chemicals due to waste processing and handling, and thus improve waste reuse and reducing the cost of treatment. In one embodiment, the invention provides a method of immobilizing heavy metal, e.g., lead, in a free flowing dry or wet waste which maintains its free flowing nature after immobilizing treatment. A waste is contacted with an effective amount of water insoluble immobilizing agent to reduce the leaching of the heavy metal to a level no more than regulatory limits (e.g., 5 ppm) lead as determined in an EPA TCLP test performed on the resulting treated waste as set forth in the Federal Register, vol. 55, no. 126, pp. 26985–26998, or California State leaching test. In another embodiment, heavy metal in a waste is immobilized such that the agent remains intact within the waste during waste wetting or handling processes. The method consists essentially of contacting the waste with a water-insoluble immobilizing agent that is capable of remaining integral to the waste matrix under normal handling conditions and remains water insoluble during wetting of the waste when quenched, sprayed or contacted with water during waste production or collection, thereby immobilizing the heavy metal. In one embodiment, heavy metal bearing residue in the form of incinerator bottom ash is, either alone or in combination with other lead bearing waste, contacted with an effective amount of a source of water for cooling and dust control of such ash and a water-insoluble precipitating agent such as pulverized phosphate rock to immobilize certain heavy metal species such that the resulting solids remaining are below TCLP regulatory limits. In a more specific embodiment, the amount of the pulverized phosphate rock is from about 0.5% to 20.0% of the ash wet weight, preferably from about 0.5% to 5.0% and more preferably from about 0.5% to 2.0%.

BRIEF DESCRIPTION OF THE DRAWING

The FIGURE shows an embodiment of the present invention in process schematic fashion showing an incinerator which allows the application of the water-insoluble phosphate rock therein prior to bottom and flyash collection.

DETAILED DESCRIPTION OF THE INVENTION

Figure 1:
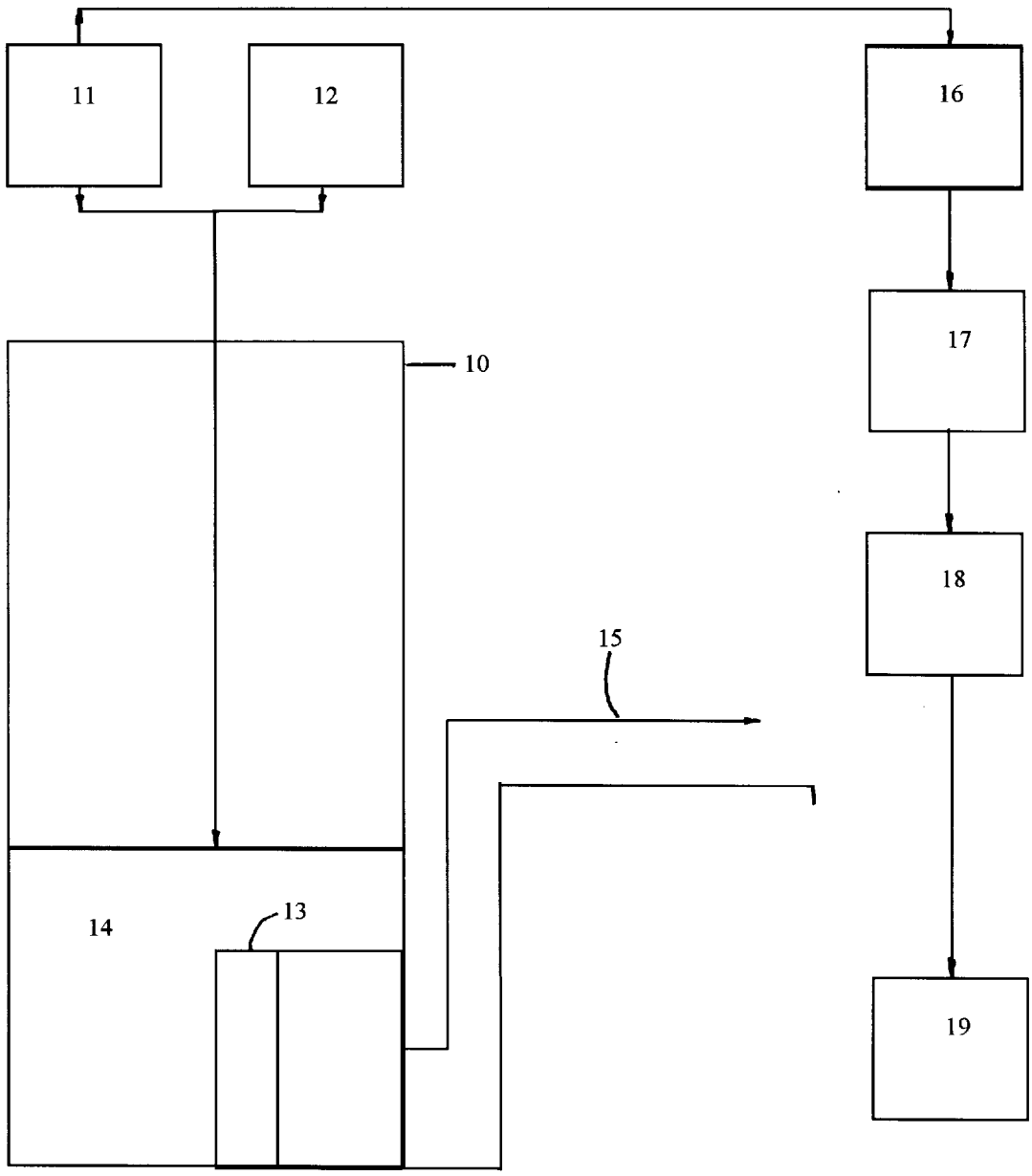

The materials being treated in the present invention are heavy metal containing wastes or contaminated materials, preferably ash by solid waste combustion and/or the ferrous and non-ferrous metals normally produced along with the bottom ash, as well as shredder residues from wire chopping and auto shredding operations which produce a fine fraction of waste separated from ferrous and non-ferrous metals. Such wastes, materials and residues contain high levels of lead and cadmium which can be leached at levels in excess of 5.0 ppm (5 mg/l) and 1.0 ppm (1 mg/l) as determined by the USEPA TCLP leaching test and copper and zinc in excess of 25.0 ppm and 200.0 ppm as determined by the California state leaching test method. When dry, the initial physical character of such solid residues and ash is a free flowing particulate mass, and a virtue of the present invention is that after treatment to immobilize these metals, the solid ash residues retain their initial free flowing granular character, which is important in the handling thereof, i.e., there is no need to change handling equipment in part because the weight, density and adhesion character of the solid residue has not been significantly modified. The present invention does not modify the drainability of the ash or modify the ash sizing, which is important since the solid ash product as produced in its original form is suitable for drainage, handling, landfilling and reuse.

The following description of the present invention is couched in terms of incinerator ash only resulting from the combustion of solid waste. This corresponds to a convenient way of carrying out the present invention, but the choice of this particular description is for expository convenience only. It is to be clearly understood that variants such as treatment of a mixture of ash with other solid residues such as fluff or other solid residues, treatment of other solid wastes or solid materials such as heavy metal contaminated soils, auto shredder residue, wire chopping insulation waste, foundry sands, sandblast wastes, and ferrous and/or non-ferrous scrap residue after combustion, or independently treating ash and then combining it with another inert solid residue are intended to be subsumed under the present invention as claimed, as are other permutations which one skilled in the art will recognize.

Incinerators for burning trash and other solid wastes are well known to those skilled in the art. Bottom ash produced from incineration is what remains on the grate of the furnace after combustion of the waste. The bottom ash is often a granular character and somewhat glassy in nature, and also includes ferrous and non-ferrous metals which are often recovered from the bottom ash by mechanical and electro-mechanical means such as screening, electromagnetic and eddy current separation. The other inert material resulting from combustion of solid wastes is flyash, a finer material which becomes airborne in the furnace and is captured in various forms of air pollution control units such as fabric filters, electrostatic precipitators, cyclones and combinations thereof. The bottom ash produced during the combustion of waste is sometimes mixed with the flyash in order to allow for use of a mixed combined ash disposal system. The bottom ash discharges from the bottom of the incinerator furnace grate at high temperatures ranging from 1500 to 2500 degree Fahrenheit, and thus requires cooling by air and/or water prior to further handling. The most common method of ash cooling is by water quenching in a drag tank or ram discharging tank which also acts as a seal to restrict air flow into the base of the furnace. The bottom ash is expelled from the wet quenching tank by means of either a pushing ram or drag flights, both which allow a controlled period of time for ash to be wetted and cooled in the bath of water prior to discharging to a removal conveyor. Both of these common ash quench expelling methods incorporate inclined drainage after the bath which allows quenching waters not retained, adsorbed or otherwise captured by the bottom ash to be returned to the quench tank. The water retained by the bottom ash and water also lost to evaporation due to the water seal exposure to heat is made up by new process water called make-up water. Referring to the FIGURE, the bottom ash primary contact tank 10 is one possible contact point for applying the water-insoluble precipitating agent to the bottom ash, with the water-insoluble precipitating agent 11 being added to the tank 10 through a water make up supply 12 at a rate to maintain a desired concentration of suspended water-insoluble precipitating agent in solution. The bottom ash 13 would be removed by dischargers 14 at a rate set for control of ash mass release from the incinerator unit as well as allowing a desired retention time of ash in contact with the water-insoluble precipitating agent solution. The water-insoluble precipitating agent solution concentration and retention time selection could vary depending on the desired reduction of heavy metal content in the ash as well as the need for reduction of soluble metals as evaluated under TCLP and other state regulatory test methods. The immobilization of heavy metals from the ash can also be completed in a tank reactor separate from the quench tank, thus being conducted in a batch mode as compared to the continuous flow mode of the ash quenching tank. After contact with the water-insoluble precipitating agent solution tank for a controlled period of time, the bottom ash is subjected to a dewatering step, preferably by gravity drainage on an inclined drag chain bed 15 or an inclined ram or by overhead drainage if the ash is placed into a batch reactor separate from the furnace ash wet quench tank. The water-insoluble precipitating agent 11 could also be injected via pneumatic blowing means to the intake side ducting 16 of the facility air pollution collection device 17, and thereafter conveyed 18 by mechanical means to a discharge point 19 with or without combination with the stabilized bottom ash.

Any convenient source of water-insoluble precipitating agent or water-soluble agent coated with a water-insoluble covering can be used in the practice of this invention. The immobilizing agent when contacted with a heavy metal containing waste or contaminated material should remain integral to the waste matrix during normal handling thereof and during wetting of the waste or contaminated material when quenched, sprayed or contacted with water during waste production or collection. The insoluble precipatating agent can be applied to the bottom ash in either a slurry or dry form. The water-insoluble precipitating agent could include solid phosphates (e.g., phosphate rock, superphosphates, Triple Superphosphate), carbonates (e.g., calcium carbonates), carbon, sulfides, magnesium oxide and combinations thereof which resist water solubility either by natural character such as pulverized phosphate rock or by engineered surface coating application onto otherwise water-soluble agent surfaces. In one embodiment, Triple Superphosphates, Superphosphates, dolomitic lime, lime, silicate powders, carbonates, sulfates and sulfides can be surface coated to minimize the premature release of stabilizing chemicals, as described below. A coating of polymer over otherwise water-soluble Triple Superphosphate (TSP) is one example of a coated chemical used currently for time release control of phosphate and nitrogen into potted and non-potted soils for rose and flower growers. In all applications, the selection of water-insoluble precipitating agent or water insoluble coatings over water-soluble agents is key in order to minimize the premature release of stabilizing chemicals during the application or exposure of the ash and/or material to rainwater, rinsing water, separation water, processing water, and/or quenching water, and to allow the release of stabilization chemicals to occur only during the exposure of the blended waste and/or material to organic acids such as dilute acetic acid or buffered acetic and/or citric acids which simulate landfill leaching conditions. Accordingly, the release of water insoluble chemicals (precipitating agent) will occur during the stabilized waste and/or material exposure to TCLP or California WET extraction fluids, as both fluids are designed to simulate the leachability of a subject waste under decomposing landfill leaching conditions. The prefered water-insoluble stabilization chemical for Pb bearing wastes and/or materials is pulverized phosphate rock such as North Carolina NATURAL PHOSPHATE and similar pre-acidulated phosphate mineral.

The amount of water-insoluble precipitating agent to be added to the ash or other solid residues combined with ash to ensure adequate TCLP immobilization will depend on such variables as bottom ash alkalinity, heavy metal content, surface character and desired reduction of TCLP leaching levels for heavy metals. It is believed that a water-insoluble phosphate rock of 0.5% by wet weight of ash to 1.0% by weight added in the ash production line prior to collection and dewatering will be sufficient to convert enough of the heavy metals such that TCLP levels are below regulatory limits of 5.0 ppm for Pb and 1.0 ppm for Cd. However, the foregoing is not intended to preclude yet higher or lower usage of water-insoluble precipitating agent or location of application as found reasonable or necessary given regulatory criteria or differences due to ash initial metals content or character.

It has been found that the TCLP character of ash varies widely from facility location and ash production type, thus causing uncertainty amongst regulators and potential ash users as to the leaching and total metals character of the ash. The present invention provides a means to reduce the TCLP variability of ash, thus improving the reusability and disposal options for ash.

The examples below are merely illustrative of this invention and are not intended to limit it thereby in any way.

EXAMPLE 1

In this example, bottom ash from a solid waste combustion facility using an ash quench tank was first subjected to a baseline TCLP analyses in order to define the character of the ash prior to stabilization and processing. The bottom ash baseline sample was subject to the Toxicity Characteristic Leaching Procedure (TCLP) as set forth in the Federal Register Vol. 55, No. 61 (Mar. 29, 1990) which corresponds in pertinent part to the procedure set forth in Federal Register, Vol. 55, No. 126, pp 26985–26998 (Jun. 29, 1990), both of which are hereby incorporated by reference. This test procedure is also referenced in EPA SW 846, 3rd Edition. The TCLP test produces an aliquot filtered solution containing soluble metals which were analyzed by ICP-MS. The bottom ash was then subjected to a 0.5%, 1.0% and 2.0% by weight basis addition of pulverized phosphate rock (Rock-P) and 0.5%, 1.0% and 2.0% polymer coated triple superphosphate (Poly TSP), and thereafter subjected to the TCLP test. The ash baseline and post-stabilized Pb concentrations are presented in Table 1 in rounded average values. The results clearly confirm the suitability of water-insoluble phosphates and polymer coated phosphates for incinerator bottom ash TCLP Pb stabilization.

TABLE 1

| RECIPE | Pb TCLP RESULTS (ppm) |
|---|---|
| Baseline | 13.5 |
| 0.5% Rock-P | 5.6 |
| 1.0% Rock-P | 1.1 |
| 2.0% Rock-P | 0.2 |
| 0.5% Poly TSP | 8.3 |
| 1.0% Poly TSP | 4.2 |
| 2.0% Poly TSP | 0.5 |

EXAMPLE 2

In this example, wire chopping waste insulation produced from a facility which separates wire insulation from copper and aluminum wire for resale of the copper and aluminum was first subjected to a baseline TCLP analyses in order to define the character of the waste insulation prior to stabilization and processing. The waste insulation was then subjected to a 0.5%, 1.0% and 2.0% by weight basis addition of pulverized phosphate rock (Rock-P) and 0.5%, 1.0% and 2.0% polymer coated triple super phosphate (Poly TSP), and thereafter subjected to the TCLP test. Given that the waste insulation is often subjected to wet quenching in order to recover additional amounts of copper and aluminum by floating PVC and PE from the heavier metal fraction, the insulation after stabilization was also subjected to water quenching and TCLP tests to confirm that the phosphate seed remained with the insulation and did not significantly solubilize or react with the water bath thus reducing TCLP leaching control. The waste baseline and post-stabilized Pb concentrations are presented in Table 2 in rounded average values. The results clearly confirm the suitability of water-insoluble phosphates and polymer coated phosphates for TCLP Pb insulation stabilization in either a dry or wetted application. The slight numerical variability noticed from the dry to wet waste TCLP testing is most likely due to the heterogeneous nature of Pb content within the insulation from a gram-to-gram basis, and is not expected to be a function of wash-out of fine phosphates from the wet separation process or changes in surface reactivity of the water insoluble phosphates.

TABLE 2

| RECIPE | Pb RESULTS DRY (ppm) | Pb RESULTS WET (ppm) |
|---|---|---|
| Baseline | 31.0 | NA |
| 0.5% Rock-P | 15.6 | 14.3 |
| 1.0% Rock-P | 5.1 | 5.3 |
| 2.0% Rock-P | 2.5 | 2.7 |
| 0.5% Poly TSP | 25.4 | 27.5 |
| 1.0% Poly TSP | 12.8 | 14.7 |
| 2.0% Poly TSP | 3.7 | 4.1 |

EXAMPLE 3

In this example, wire chopping waste insulation was subjected to a 0.5%, 1.0% and 2.0% by weight basis addition of non-pulverized phosphate rock and thereafter subjected to the TCLP test. This non-pulverized phosphate rock was investigated in order to determine impact of pulverization of rock on the availability of surface active phosphate sites for stabilization of Pb under the TCLP test as well as the impact of pulverization on the control of sifting of chemical from the waste insulation. The non-pulverized phosphate rock used had a Tyler size distribution on 100% passing at 14 mesh, 97% pass at 35 mesh, 49% pass at 65 mesh, 19% pass at 100 mesh and 1% pass at 200 mesh, as compared to the pulverized rock used in Examples 1 and 2 which had 85% passing at 200 mesh. The application of the non-pulverized phosphate rock to the dry wire insulation was found to sift out 50% to 60% of the addition with a single tumble in a 1000 ml container of 100 grams of wire insulation and a 2% application of rock. This sifting phenomena was considered troublesome, as the stabilization chemical was not staying integrated within the waste regardless of mixing methods used. A laboratory simulation of roadway hauling of the mixed dry insulation and the rock, pulverized rock and lower density triple superphosphate (TSP) prills were conducted in order to determine if the phosphate rock, pulverized rock and/or TSP would sift away from the upper layers of the waste insulation and thus cause the upper layer of a truck load of stabilized waste to fail a composite TCLP sample analyses as received at a landfill after vibrations from hauling. The simulation involved applying a well mixed phosphate rock, pulverized rock and TSP at 2% wet weight basis to dry insulation waste on a shaker table set at 120 strokes per minute. A surface composite waste sample was then collected from the table samples for TCLP analyses. The waste baseline and post-stabilized Pb concentrations are presented in Table 3 in rounded average values. The results clearly confirm that water-insoluble non-pulverized phosphates were not as effective as pulverized phosphate rock or TSP in passing TCLP and that the non-pulverized rock allowed for sifting which greatly increased TCLP levels of samples collected from a source subjected to vibration after application of the phosphate rock. The pulverized rock coated the insulation and remained as a uniform coating on the waste regardless of vibration. The TSP prills also remained integrated within the waste insulation and did not sift, yet the prills did not adhere to the insulation as did the pulverized phosphates. The prills remained uniform within the waste insulation due to their density of 55 to 60 lbs per cubic foot which was very similar to the waste insulation of 45 to 50 pcf and their semi-round shape and size of 6 to 16 Tyler mesh which allowed for the prills to hold between bridges of waste insulation without separating. The prills also have an angle of repose of 25 to 30 degrees and a somewhat irregular surface which improves bridging behavior of the prill within the insulation waste matrix.

TABLE 3

| RECIPE | Pb DRY (ppm) | Pb Sifted (ppm) |
|---|---|---|
| Baseline | 31.0 | NA |
| 0.5% Rock | 30.5 | 32.0 |
| 1.0% Rock | 20.1 | 29.0 |
| 2.0% Rock | 14.5 | 27.4 |
| 0.5% Rock-P | 15.6 | 16.3 |
| 1.0% Rock-P | 5.1 | 5.4 |
| 2.0% Rock-P | 2.5 | 2.2 |
| 0.5% Poly TSP | 25.4 | 25.5 |
| 1.0% Poly TSP | 12.8 | 11.8 |
| 2.0% Poly TSP | 3.7 | 4.1 |

EXAMPLE 4

In this example, flyash scrubber residue from a refuse-derived fuel solid waste combustion facility using an ash DUSTMASTER mixing and conditioner for ash wetting was first subjected to a baseline TCLP analyses in order to define the character of the ash prior to stabilization and processing. The flyash was subjected to a 2.0% by weight basis addition of pulverized phosphate rock (Rock-P) by injection of the Rock-P into the facility gas collection device prior to the collection of flyash onto a facility baghouse filtering device. The flyash and Rock-P were effectively mixed together in the gas stream ahead of the baghouse filters which collect the flyash residue after combustion of municipal solid waste, and the flyash and Rock-P combination was then collected in facility ash collection hoppers and transferred to the facility DUSTMASTER mixer for water addition as dust control. After mixing in the DUSTMASTER the flyash and Rock-P were thereafter subjected to the TCLP test. The flyash baseline and post-stabilized Pb concentrations are presented in Table 1 in rounded average values. The results clearly confirm the suitability of water-insoluble phosphates for incinerator flyash scrubber residue TCLP Pb and Cd stabilization.

TABLE 4

| RECIPE | Pb TCLP RESULTS (ppm) |
|---|---|
| Baseline | 28.5 |
| 2.0% Rock-P | 2.1 |

The foregoing results readily establish the operability of the present process to reduce leachable soluble metals in waste residues and materials and to provide a chemical stabilizing agent which remains effective and non-reactive under water quenching conditions and under waste sifting conditions. The degree of reduction of heavy metal leaching can be regulated by the operator and would likely depend on the baseline character of the waste as well as regulatory criteria relative to the waste reuse or disposal options. The above described process allows for a wide range of operations options and is highly flexible given ones ability to adjust process variables such as water insoluble precipitation election and dosages, wetting degree and application point of stabilization chemical. It is expected that the most common element of regulatory concern, Pb, will be reduced and controlled to suitable TCLP levels using a 0.5 to 2.5 weight basis addition of water-insoluble agent.

It will be apparent from the foregoing that many other variations and modifications can be made in the methods and the compositions herein before described, by those having experience in this technology, without departing from the concept of the present invention. Accordingly, it should be clearly understood that the methods and compositions referred to herein in the foregoing description are illustrative only and are not intended to have any limitations on the scope of the invention.

I claim:

1. A method of immobilizing heavy metal in a free flowing dry or wet waste which maintains its free flowing nature after immobilizing treatment, said method consisting essentially of:

contacting a waste with an effective amount of water insoluble immobilizing agent to reduce the leaching of the heavy metal to a level no more than regulatory limits as determined in an EPA TCLP test performed on the resulting treated waste as set forth in the Federal Register, vol 55, no. 126, pp. 26985–26998.

2. The method of claim 1, wherein the water-insoluble agent is selected from the group consisting of natural minerals, phosphate rock, pulverized phosphate rock, calcium carbonates, magnesium oxides and carbon.

3. The method of claim 1, wherein the water-insoluble agent comprises a water-soluble agent having a water-insoluble coating thereon, wherein the water-soluble agent is selected from the group consisting of triple superphosphates, superphosphates, dolomitic lime, lime, silicate powders, carbonates, sulfates and sulfides, wherein an applied surface coating onto the water-soluble precipitating agent provides a surface character which is water-insoluble.

4. The method of claim 1, wherein the waste is selected from the group consisting of bottom ash, flyash, scrubber residue and combinations thereof resulting from the combustion of solid waste.

5. The method of claim 1, wherein the waste is selected from the group consisting of shredder fluff resulting from the shredding of automobiles, shredding of wire, shredding of white goods and combinations thereof.

6. The method of claim 1 wherein the heavy metal is selected from the group consisting of lead, cadmium, copper and zinc.

7. A method of immobilizing heavy metal in a free flowing dry or wet waste or heavy metal contaminated material which maintains its free flowing nature after immobilizing treatment, said method consisting essentially of:

contacting the waste or contaminated material with an effective amount of an immobilizing agent to reduce the leaching of the heavy metal to a level no more than regulatory limits as determined in a California State leaching test or an EPA TCLP test performed on the resulting treated waste or contaminated material, as set forth in the Federal Register, vol. 55, no. 126, pp. 26985–26998; wherein the immobilizing agent is selected from the group consisting of phosphate rock, pulverized phosphate rock, triple superphosphate, superphosphate, silicate, magnesium oxide, sulfates, sulfides and lime, said immobilizing agent being capable of remaining integral to the waste or contaminated material matrix during wetting of the waste or contaminated material when quenched, sprayed or contacted with water during waste production or collection, thereby immobilizing the heavy metal.

8. The method of claim 7, wherein the waste is selected from the group consisting of bottom ash, flyash, scrubber residue and combinations thereof resulting from the combustion of solid waste.

9. The method of claim 7, wherein the waste is selected from the group consisting of shredder fluff resulting from the shredding of automobiles, shredding of wire, shredding of white goods and combinations thereof.

10. The method of claim 7, wherein the waste is contacted with at least one immobilizing agent in the amount of 0.01% to 20.0% by weight of agent based on the total waste.

* * * * *